US011333369B2

(12) United States Patent
Onaka et al.

(10) Patent No.: US 11,333,369 B2
(45) Date of Patent: May 17, 2022

(54) REFRIGERANT DISTRIBUTOR, HEAT EXCHANGER, AND AIR-CONDITIONING APPARATUS

(71) Applicant: Mitsubishi Electric Corporation, Tokyo (JP)

(72) Inventors: Yoji Onaka, Tokyo (JP); Shigeyoshi Matsui, Tokyo (JP); Takashi Matsumoto, Tokyo (JP); Rihito Adachi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/972,010

(22) PCT Filed: Jun. 11, 2018

(86) PCT No.: PCT/JP2018/022146
§ 371 (c)(1),
(2) Date: Dec. 4, 2020

(87) PCT Pub. No.: WO2019/239445
PCT Pub. Date: Dec. 19, 2019

(65) Prior Publication Data

US 2021/0190331 A1 Jun. 24, 2021

(51) Int. Cl.
*F24F 1/0068* (2019.01)
*F24F 1/0059* (2019.01)
(Continued)

(52) U.S. Cl.
CPC ..... *F24F 1/32* (2013.01); *F24F 1/0059* (2013.01); *F24F 1/0068* (2019.02);
(Continued)

(58) Field of Classification Search
CPC ... F24F 1/0059; F24F 1/0068; F28D 1/05375; F28D 1/0426; F28D 2001/0266; F28F 9/0273
See application file for complete search history.

(56) References Cited

U.S. PATENT DOCUMENTS

2015/0122470 A1* 5/2015 Xia ..... F28F 9/0273 165/174

FOREIGN PATENT DOCUMENTS

JP 2005-133966 A 5/2005
JP 2012-2475 A 1/2012
(Continued)

OTHER PUBLICATIONS

International Search Report and Written Opinion dated Aug. 14, 2018, received for PCT Application No. PCT/JP2018/022146, Filed on Jun. 11, 2018, 6 pages including English Translation.
(Continued)

*Primary Examiner* — Lionel Nouketcha
(74) *Attorney, Agent, or Firm* — Xsensus LLP

(57) ABSTRACT

A refrigerant distributor has a double-pipe structure including an inner pipe and an outer pipe. A plurality of outer pipes are disposed, each of the plurality of outer pipes being the outer pipe. A space is formed between adjacent ones of the plurality of outer pipes. The inner pipe is disposed to be continuous through the plurality of outer pipes. A plurality of heat-transfer tubes are arrayed in a direction in which the outer pipe extends and connected to the outer pipe. The refrigerant distributor distributes refrigerant flowing into between the inner pipe and the outer pipe to the plurality of heat-transfer tubes.

13 Claims, 11 Drawing Sheets

(51) Int. Cl.

| | |
|---|---|
| ***F24F 1/32*** | (2011.01) |
| *F28D 1/053* | (2006.01) |
| *F28D 21/00* | (2006.01) |
| *F28F 9/02* | (2006.01) |

(52) U.S. Cl.
CPC .. *F28D 1/05375* (2013.01); *F28D 2021/0068* (2013.01); *F28F 9/0273* (2013.01)

(56) References Cited

FOREIGN PATENT DOCUMENTS

| | | | |
|---|---|---|---|
| JP | 2015-203506 | A | 11/2015 |
| JP | 2017-32244 | A | 2/2017 |

OTHER PUBLICATIONS

Wijayanta et al., "Liquid-Vapor Phase Distribution in Horizontal Headers with Upward Minichannel-Branching Conduits", Experimental Thermal and Fluid Science, vol. 76, 2016, pp. 264-274.
Chinese Office Action dated Nov. 10, 2021 in Chinese Application No. 201880093545.8.

* cited by examiner

REFRIGERANT DISTRIBUTOR, HEAT EXCHANGER, AND AIR-CONDITIONING APPARATUS

CROSS-REFERENCE TO RELATED APPLICATION

The present application is based on PCT filing PCT/JP2018/022146, filed Jun. 11, 2018, the entire contents of which are incorporated herein by reference.

TECHNICAL FIELD

The present disclosure relates to a refrigerant distributor, a heat exchanger, and an air-conditioning apparatus in which, when a heat exchanger functions as an evaporator, two-phase gas-liquid refrigerant flows through the refrigerant distributor.

BACKGROUND ART

In existing air-conditioning apparatuses, liquid refrigerant condensed by a heat exchanger that functions as a condenser and that is accommodated in an indoor unit is decompressed by an expansion device. The refrigerant in a two-phase gas-liquid state in which gas refrigerant and liquid refrigerant are mixed together then flows into a heat exchanger that functions as an evaporator and that is accommodated in an outdoor unit. When two-phase gas-liquid refrigerant flows into a heat exchanger that functions as an evaporator, the performance of distributing the refrigerant to the heat exchanger is impaired. For example, there is a method for improving refrigerant distribution performance. In the method, to improve refrigerant distribution performance, flat tubes of a heat exchanger accommodated in an outdoor unit are disposed vertically upward, and a refrigerant distributor is disposed horizontally. Thus, the effect of gravity is reduced, and the refrigerant distribution performance is improved. However, even if a refrigerant distributor is horizontally disposed as described above, for example, there arises a problem in that the distribution performance fluctuates, depending on the flow rate of the refrigerant flowing in the refrigerant distributor or the refrigerant quality. For this reason, there arises a problem in that only a slight deviation of a value of a refrigerant flow condition from a design center value impairs the distribution performance and the heat exchange performance of a heat exchanger and thus causes an impairment in energy efficiency.

To solve such a problem, a technique for improving refrigerant distribution performance is proposed (for example, see Patent Literature 1). In the technique, a refrigerant distributor has a double-pipe structure, a plurality of refrigerant outlets are disposed side by side in an inner pipe, and the refrigerant distribution performance is improved.

CITATION LIST

Patent Literature

Patent Literature 1: Japanese Unexamined Patent Application Publication No. 2015-203506

SUMMARY OF INVENTION

Technical Problem

In the technique in Patent Literature 1, in the case of heat-transfer tubes made of flat tubes, an outer pipe whose width is at least larger than the length of the major axis of each flat tube has to be used. For this reason, there arises a problem of the outer pipe of the double pipe having a large volume. In addition, there arises a problem in that heat exchange efficiency is impaired due to a large amount of refrigerant liquid remaining in the refrigerant distributor during a condensing operation.

The present disclosure is made to overcome the above problems, and an object of the refrigerant distributor of the present disclosure is to provide a refrigerant distributor that has a small volume and with which heat exchange efficiency is improved, a heat exchanger, and an air-conditioning apparatus.

Solution to Problem

A refrigerant distributor according to an embodiment of the present disclosure has a double-pipe structure including an inner pipe and an outer pipe. A plurality of outer pipes are disposed, each of the plurality of outer pipes being the outer pipe. A space is formed between adjacent ones of the plurality of outer pipes. The inner pipe is disposed to be continuous through the plurality of outer pipes. A plurality of heat-transfer tubes are arrayed in a direction in which the outer pipe extends and connected to the outer pipe. The refrigerant distributer distributes refrigerant flowing into between the inner pipe and the outer pipe to the plurality of heat-transfer tubes.

A heat exchanger according to another embodiment of the present disclosure includes the refrigerant distributor.

An air-conditioning apparatus according to still another embodiment of the present disclosure includes the heat exchanger. The direction in which the inner pipe of the refrigerant distributor of the heat exchanger extends is kept horizontal, and refrigerant containing liquid refrigerant flows into the inner pipe from one end of the inner pipe.

Advantageous Effects of Invention

In the refrigerant distributor, the heat exchanger, and the air-conditioning apparatus according to the embodiments of the present disclosure, the plurality of outer pipes are disposed, the space is formed between adjacent ones of the plurality of outer pipes, and the inner pipe is disposed to be continuous through the plurality of outer pipes. Thus, when the refrigerant distributor distributes refrigerant to the plurality of heat exchangers, the refrigerant flows through only the inner pipe and the outer pipes adjacent to each other. As a result, it is possible to reduce the amount of refrigerant. In addition, the space is formed between the outer pipes adjacent to each other, and the inner pipe is disposed to be continuous through the plurality of outer pipes. Thus, the refrigerant distributor is reduced in size, and it is possible to assemble the heat exchangers with high density. In addition, when the heat exchanger functions as a condenser, it is possible to reduce impairment of heat exchange efficiency due to liquid refrigerant remaining inside the refrigerant distributor. Thus, the refrigerant distributor has a small volume, and heat exchange efficiency is improved.

DESCRIPTION OF EMBODIMENTS

Figure 1:
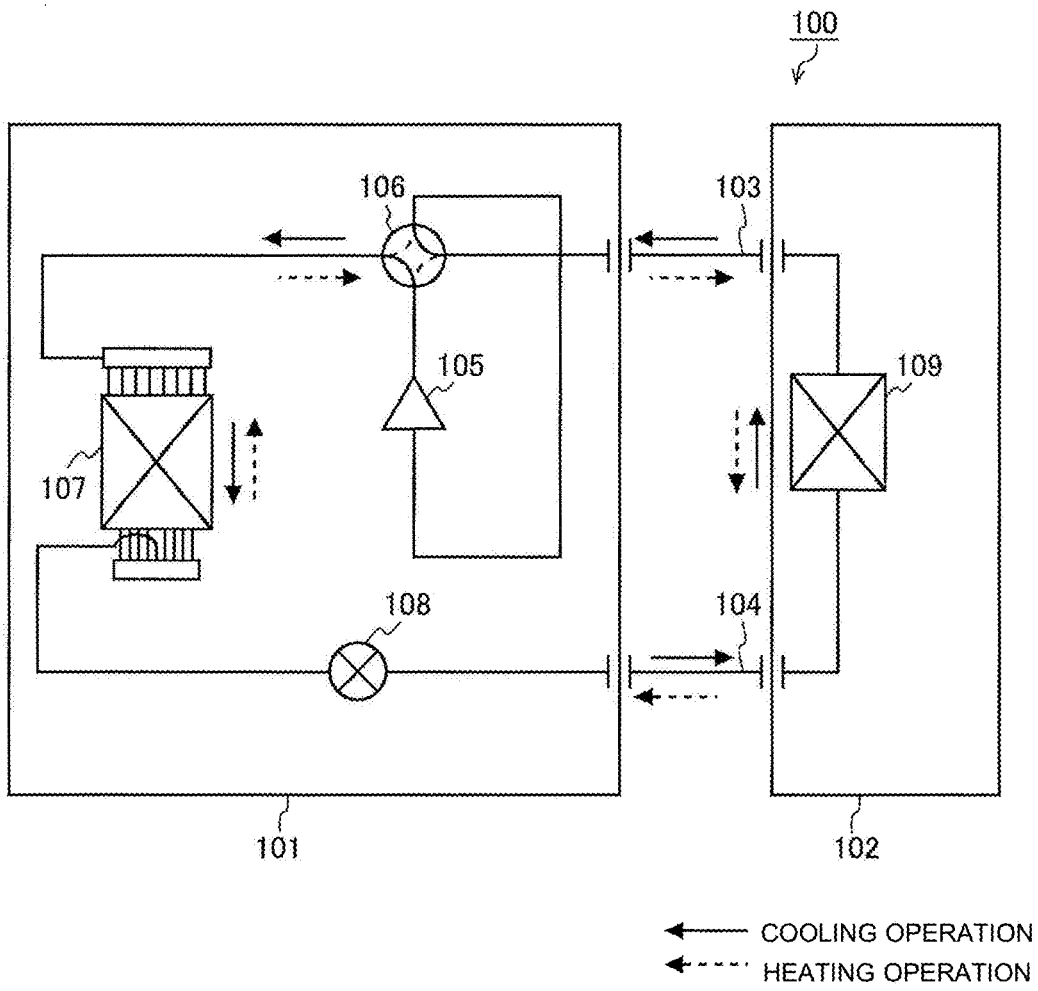
FIG. 1 is a diagram of a refrigerant circuit illustrating an air-conditioning apparatus according to Embodiment 1 of the present disclosure.

Embodiments of the present disclosure will be described below with reference to the drawings. In the drawings, components having the same reference signs are the same or equivalent components, and this applies to the whole description. In the sectional views, hatching is omitted as appropriate in view of recognizability. In addition, the forms of the components in the whole description are merely examples, and the forms of the components are not limited to those in the description.

Embodiment 1

<Configuration of Air-Conditioning Apparatus 100>

FIG. 1 is a diagram of a refrigerant circuit illustrating an air-conditioning apparatus 100 according to Embodiment 1 of the present disclosure. In the air-conditioning apparatus 100 illustrated in FIG. 1, an outdoor unit 101 and an indoor unit 102 are connected by a gas refrigerant pipe 103 and a liquid refrigerant pipe 104.

The outdoor unit 101 includes a compressor 105, a four-way valve 106, an outdoor heat exchanger 107, and an expansion valve 108.

The compressor 105 compresses and discharges suctioned refrigerant. The compressor 105 may vary the amount of refrigerant sent by the compressor 105 per unit time by freely varying operating frequency with, for example, an inverter circuit.

The four-way valve 106 is a valve that switches between, for example, a refrigerant flow in a cooling operation and a refrigerant flow in a heating operation.

The outdoor heat exchanger 107 exchanges heat between refrigerant and outdoor air. The outdoor heat exchanger 107 functions as a condenser in the cooling operation and condenses and liquifies refrigerant. The outdoor heat exchanger 107 functions as an evaporator in the heating operation and evaporates and gasifies refrigerant.

The expansion valve 108 is a flow control valve and decompresses and expands refrigerant. For example, in the case of the expansion valve 108 composed of an electronic expansion valve, the opening degree of the expansion valve 108 can be controlled by instructions from a controller (not illustrated) or other devices.

The indoor unit 102 includes an indoor heat exchanger 109. For example, the indoor heat exchanger 109 exchanges heat between air-conditioning target air and refrigerant. The indoor heat exchanger 109 functions as an evaporator in the cooling operation and evaporates and gasifies refrigerant. The indoor heat exchanger 109 functions as a condenser in the heating operation and condenses and liquifies refrigerant.

As described above, the configuration of the air-conditioning apparatus 100 enables refrigerant flows to be switched with the four-way valve 106 of the outdoor unit 101, and thus the cooling operation and the heating operation can be performed.

<Configuration of Outdoor Unit 101 of Air-Conditioning Apparatus 100>

Figure 2:
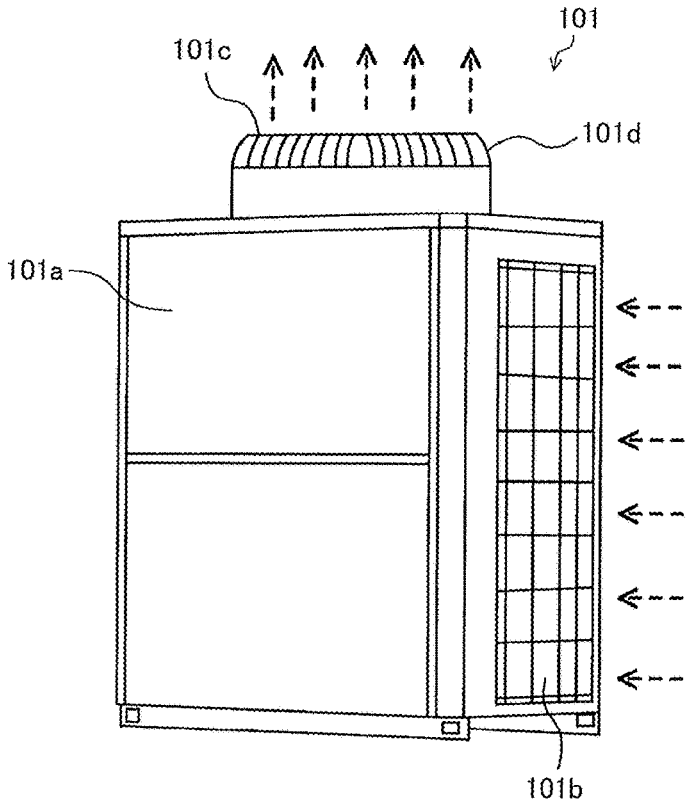
FIG. 2 is a side view illustrating an outdoor unit of the air-conditioning apparatus according to Embodiment 1 of the present disclosure.

FIG. 2 is a side view illustrating the outdoor unit 101 of the air-conditioning apparatus 100 according to Embodiment 1 of the present disclosure. Dashed arrows in FIG. 2 represent airflow.

The outdoor unit 101 of the air-conditioning apparatus 100 accommodates the outdoor heat exchanger 107. The outdoor unit 101 of the air-conditioning apparatus 100 is a top-flow outdoor unit. A refrigeration cycle circuit is formed by circulating refrigerant between the outdoor unit 101 and the indoor unit 102. The outdoor unit 101 is used as, for example, an outdoor unit of a multi-air-conditioning apparatus for buildings and is installed on a building roof or in other places.

As illustrated in FIG. 2, the outdoor unit 101 includes a casing 101*a*, which is shaped like a box. An air inlet 101*b*, which is open in a side of the casing 101*a*, is formed in the outdoor unit 101. The outdoor unit 101 includes the outdoor heat exchanger 107, which is disposed in the casing 101*a* along the air inlet 101*b*. An air outlet 101*c*, which is open in the top of the casing 101*a*, is formed in the outdoor unit 101. The outdoor unit 101 includes a fan guard 101*d*, which is disposed to cover the air outlet 101*c* and through which air flows. The outdoor unit 101 includes a top-flow fan 90, which is disposed inside the fan guard 101*d* and sucks outside air through the air inlet 101*b* and discharges exhaust air that has been subjected to heat exchange from the air outlet 101*c*.

<Outdoor Heat Exchanger 107>

Figure 3:
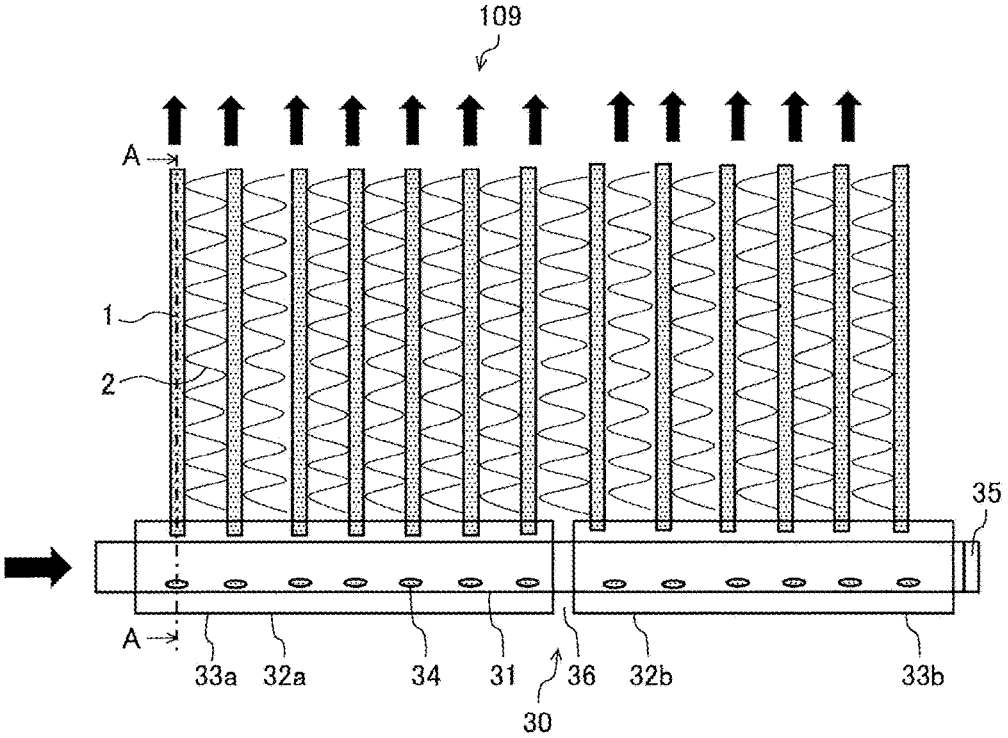
FIG. 3 is a schematic side view illustrating a heat exchanger according to Embodiment 1 of the present disclosure.

FIG. 3 is a schematic side view illustrating the outdoor heat exchanger 107 according to Embodiment 1 of the present disclosure. Black arrows in FIG. 3 represent refrigerant flow when the outdoor heat exchanger 107 functions as an evaporator.

The outdoor heat exchanger 107 accommodated in the outdoor unit 101 of the air-conditioning apparatus 100 exchanges heat between refrigerant and the outside air sucked through the air inlet 101*b* by the fan 90. The outdoor heat exchanger 107 is disposed below the fan 90.

As illustrated in FIG. 3, the outdoor heat exchanger 107 includes a plurality of fins 2, a plurality of heat-transfer tubes 1, and a refrigerant distributor 30. The fins 2 are disposed side by side with spaces therebetween. The heat-transfer tubes 1 are disposed side by side with each of the fins 2 interposed therebetween. The refrigerant distributor 30 is disposed horizontal to gravity. At least two outdoor heat exchangers 107 are disposed.

<Refrigerant Distributor 30>

As illustrated in FIG. 3, the refrigerant distributor 30 has a double-pipe structure including an inner pipe 31 and outer pipes 32*a* and 32*b*. At least two outer pipes 32*a* and 32*b* are disposed such that the number of the outer pipes 32*a* and 32*b* is equal to that of the outdoor heat exchangers 107. A space 36 is formed between the outer pipes 32*a* and 32*b* adjacent to each other of a plurality of outer pipes 32*a* and 32*b*. One inner pipe 31 is disposed to be continuous through the plurality of outer pipes 32*a* and 32*b*. The heat-transfer tubes 1 are arrayed in a direction in which the outer pipes 32*a* and 32*b* extend and connected to the outer pipes 32*a* and 32*b*. The refrigerant distributor 30 thereby distributes refrigerant flowing into between the inner pipe 31 and the outer pipe 32*a* and into between the inner pipe 31 and the outer pipe 32*b* to the heat-transfer tubes 1.

That is, the refrigerant distributor 30 includes, separately, the outer pipe 32*a*, which is on the upstream side in the refrigerant distributor 30, and the outer pipe 32*b*, which is on the downstream side in the refrigerant distributor 30, whereas the refrigerant distributor 30 includes only one inner pipe 31 to be continuous through the outer pipes 32*a* and 32*b*. A direction in which the inner pipe 31 extends is kept horizontal. Refrigerant containing liquid refrigerant flows into the inner pipe 31 from one end of the inner pipe 31. A cap 35 is disposed at the most downstream end of the inner pipe 31 in a refrigerant flow when the outdoor heat exchanger 107 functions as an evaporator to seal the inner pipe 31. A refrigerant pipe 62 of the refrigeration cycle circuit is connected to the most upstream end of the inner pipe 31 in a refrigerant flow when the outdoor heat exchanger 107 functions as an evaporator.

With this structure, it is possible to reduce the outer pipe volume of the part where the outdoor heat exchangers 107 are connected, the part not contributing to refrigerant distribution performance. Accordingly, it is possible to reduce the amount of refrigerant flowing through the refrigerant distributor 30. In addition, only the inner pipe 31 is continuous through and connects the two outer pipes 32*a* and 32*b*, and thus the outdoor heat exchangers 107 can be easily bent by bending only the inner pipe 31. As a result, it is possible to assemble the outdoor heat exchangers 107 with high density.

A plurality of refrigerant outlets 34 are formed at the inner pipe 31. The refrigerant outlets 34 are openings disposed side by side with spaces therebetween in the direction in which the inner pipe 31 extends in a plurality of double-pipe portions 33*a* and 33*b*. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31. The inner pipe 31 has the refrigerant outlets 34 disposed side by side as described above, and thus two-phase gas-liquid refrigerant flows through the inner pipe 31 and passes through the refrigerant outlets 34 when the outdoor heat exchanger 107 functions as an evaporator. Agitated two-phase gas-liquid refrigerant then flows in the space defined by the inner pipe 31 and the outer pipe 32*a* on the upstream side, and in the space defined by the inner pipe 31 and the outer pipe 32*b* on the downstream side. As described above, refrigerant passes through the refrigerant outlets 34, and two-phase gas-liquid refrigerant is agitated. Thus, the refrigerant flows like a homogeneous flow. As a result, the refrigerant distribution performance is improved, and it is possible to improve the performance of the outdoor heat exchanger 107. In addition, when the outdoor heat exchanger 107 functions as a condenser, it is possible to reduce impairment of heat exchange efficiency because refrigerant liquid hardly remains inside the refrigerant distributor 30.

<Details of Section of Refrigerant Distributor 30>

Figure 4:
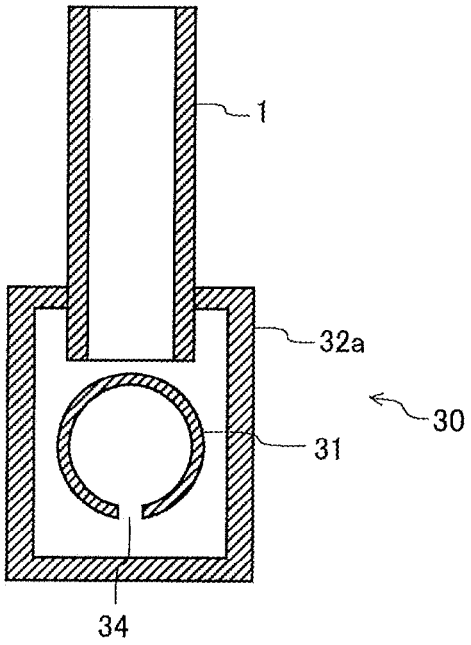
FIG. 4 is a sectional view taken along line A-A in FIG. 3 illustrating an example of a refrigerant distributor according to Embodiment 1 of the present disclosure.

FIG. 4 is a sectional view taken along line A-A in FIG. 3 illustrating an example of the refrigerant distributor 30 according to Embodiment 1 of the present disclosure. The refrigerant distributor 30 illustrated in FIG. 4 has a configuration in which the outer pipes 32*a* and 32*b* are made of rectangular pipes, the inner pipe 31 is made of a circular pipe, and the refrigerant outlets 34 are disposed to face downward. The outer pipes 32*a* and 32*b* are made of rectangular pipes, and thus the length of the refrigerant distributor 30 in the column direction can be reduced in the case of the heat-transfer tubes 1 made of flat tubes.

<Modification 1 of Refrigerant Distributor 30>

Figure 5:
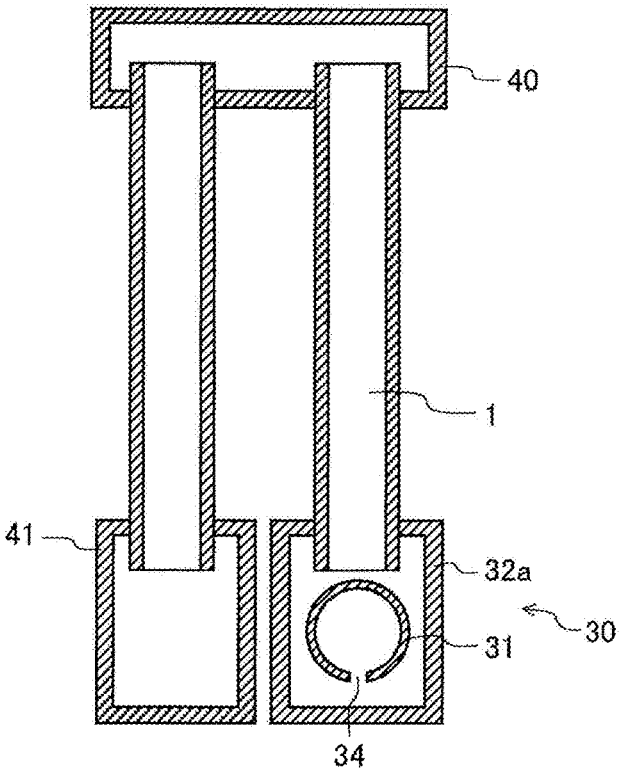
FIG. 5 is a sectional view illustrating another example of the refrigerant distributor according to Embodiment 1 of the present disclosure.

FIG. 5 is a sectional view illustrating another example of the refrigerant distributor 30 according to Embodiment 1 of the present disclosure. Hereinafter, the same configuration as that in the above embodiment is not described, and only its features are described. As illustrated in FIG. 5, when the outdoor heat exchangers 107 are disposed in two columns, the refrigerant distributor 30 or header collecting pipes 40 and 41 can be disposed without steps. Thus, the frontal areas of the outdoor heat exchangers 107 can be increased. In addition, the joints in the heat-transfer tubes 1, which are flat tubes, are straight, and thus the heat-transfer tubes 1 can have uniform brazing margins. As a result, the ease of brazing is improved.

<Modification 2 of Refrigerant Distributor 30>

Figure 6:
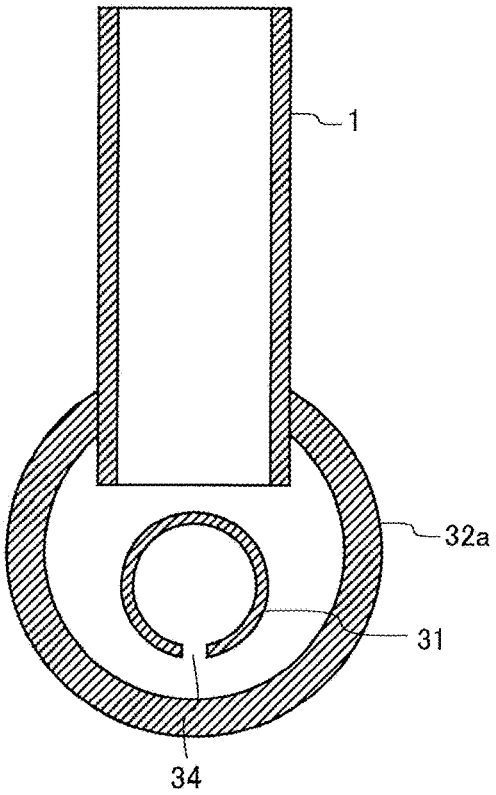
FIG. 6 is a sectional view illustrating still another example of the refrigerant distributor according to Embodiment 1 of the present disclosure.

FIG. 6 is a sectional view illustrating still another example of the refrigerant distributor 30 according to Embodiment 1 of the present disclosure. Hereinafter, the same configuration as that in the above embodiment is not described, and only its features are described. As illustrated in FIG. 6, the refrigerant distributor 30 includes the outer pipes 32*a* and 32*b* and the inner pipe 31 made of circular pipes, and the refrigerant outlets 34 formed to face downward. The outer pipes 32*a* and 32*b* and the inner pipe 31 are made of circular pipes, and thus the refrigerant distributor 30 has excellent pressure resistance. In addition, the distances in the radial direction of sections orthogonal to the pipe-extending direction between the outer pipe 32*a* and the inner pipe 31 and between the outer pipe 32*b* and the inner pipe 31 are uniform. Thus, agitated refrigerant can be distributed to the heat-transfer tubes 1 with its homogeneous state maintained.

In Embodiment 1, the pipe shapes of the outer pipes 32*a* and 32*b* and the inner pipe 31 of the refrigerant distributor 30 are illustrated. However, the present disclosure is not limited to those shapes. In addition, in Embodiment 1, only the example in which the refrigerant outlets 34 of the inner pipe 31 of the refrigerant distributor 30 face downward is described. However, this is merely an example, and the direction in which the refrigerant outlets 34 face is not limited thereto. In addition, in Embodiment 1, the outdoor heat exchanger 107 including the refrigerant distributor 30 accommodated in the top-flow outdoor unit is described as merely an example. However, the configuration is not limited thereto. The outdoor heat exchanger 107 including the refrigerant distributor 30 may be accommodated as a heat exchanger of, for example, indoor units or side-flow outdoor units such as outdoor units of room air-conditioning apparatuses or packaged air-conditioning apparatuses.

Effects of Embodiment 1

According to Embodiment 1, the refrigerant distributor 30 has a double-pipe structure including the inner pipe 31 and the outer pipes 32*a* and 32*b*. A plurality of outer pipes 32*a* and 32*b* are disposed, each of the plurality of outer pipes 32*a* and 32*b* being respectively the outer pipes 32*a* and 32*b*. The space 36 is formed between the outer pipes 32*a* and 32*b* adjacent to each other of the plurality of outer pipes 32*a* and 32*b*. One inner pipe 31 is disposed to be continuous through the plurality of outer pipes 32*a* and 32*b*. The plurality of heat-transfer tubes 1 are arrayed in the direction in which the outer pipes 32*a* and 32*b* extend and connected to the outer pipes 32*a* and 32*b*. The refrigerant distributor 30 thereby distributes refrigerant flowing into between the inner pipe 31 and the outer pipe 32*a* and into between the inner pipe 31 and the outer pipe 32*b* to the heat-transfer tubes 1.

With this configuration, when the refrigerant distributor 30 distributes refrigerant to the plurality of outdoor heat exchangers 107, the refrigerant flows through only the inner pipe 31 and the outer pipes 32*a* and 32*b* adjacent to each other. Thus, it is possible to reduce the amount of refrigerant. In addition, the space is formed between the outer pipes 32*a* and 32*b* adjacent to each other, and one inner pipe 31 is disposed to be continuous through the plurality of outer pipes 32*a* and 32*b*. Thus, the refrigerant distributor 30 is reduced in size, and it is possible to assemble the outdoor heat exchangers 107 with high density. In addition, when the outdoor heat exchanger 107 functions as a condenser, it is possible to reduce impairment of heat exchange efficiency due to liquid refrigerant remaining inside the refrigerant distributor 30. Thus, the refrigerant distributor 30 has a small volume, and heat exchange efficiency is improved.

According to Embodiment 1, the plurality of refrigerant outlets 34 are formed at the inner pipe 31. The refrigerant outlets 34 are openings disposed side by side with spaces therebetween in the direction in which the inner pipe 31 extends in the plurality of double-pipe portions 33*a* and 33*b*. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31.

With this configuration, two-phase gas-liquid refrigerant flows through the inner pipe 31 and passes through the refrigerant outlets 34 when the outdoor heat exchanger 107 functions as an evaporator. Agitated two-phase gas-liquid refrigerant then flows in the internal space of the outer pipe 32*a* of the double-pipe portion 33*a*, which is defined by the inner pipe 31 and the outer pipe 32*a* on the upstream side, and in the internal space of the outer pipe 32*b* of the double-pipe portion 33*b*, which is defined by the inner pipe 31 and the outer pipe 32*b* on the downstream side. As described above, refrigerant passes through the refrigerant outlets 34 and is agitated. Thus, the refrigerant flows like a homogeneous flow. As a result, the refrigerant distribution performance is improved, and it is possible to improve the performance of the outdoor heat exchanger 107.

According to Embodiment 1, the outdoor heat exchanger 107 includes the refrigerant distributor 30.

With this configuration, in the outdoor heat exchanger 107 including the refrigerant distributor 30, the refrigerant distributor 30 has a small volume, and heat exchange efficiency is improved.

According to Embodiment 1, the air-conditioning apparatus 100 includes the outdoor heat exchanger 107. In particular, it is preferable that the inner pipe 31 of the refrigerant distributor 30 be disposed such that the direction in which the inner pipe 31 extends is horizontal and that refrigerant containing liquid refrigerant flow into the inner pipe 31 from one end of the inner pipe 31. In this case, liquid refrigerant can easily flow to the other end of the inner pipe 31, and thus refrigerant is distributed satisfactorily.

With this configuration, in the air-conditioning apparatus 100 including the outdoor heat exchanger 107, the refrigerant distributor 30 has a small volume, and heat exchange efficiency is improved.

Embodiment 2

<Outdoor Heat Exchanger 107>

Figure 7:
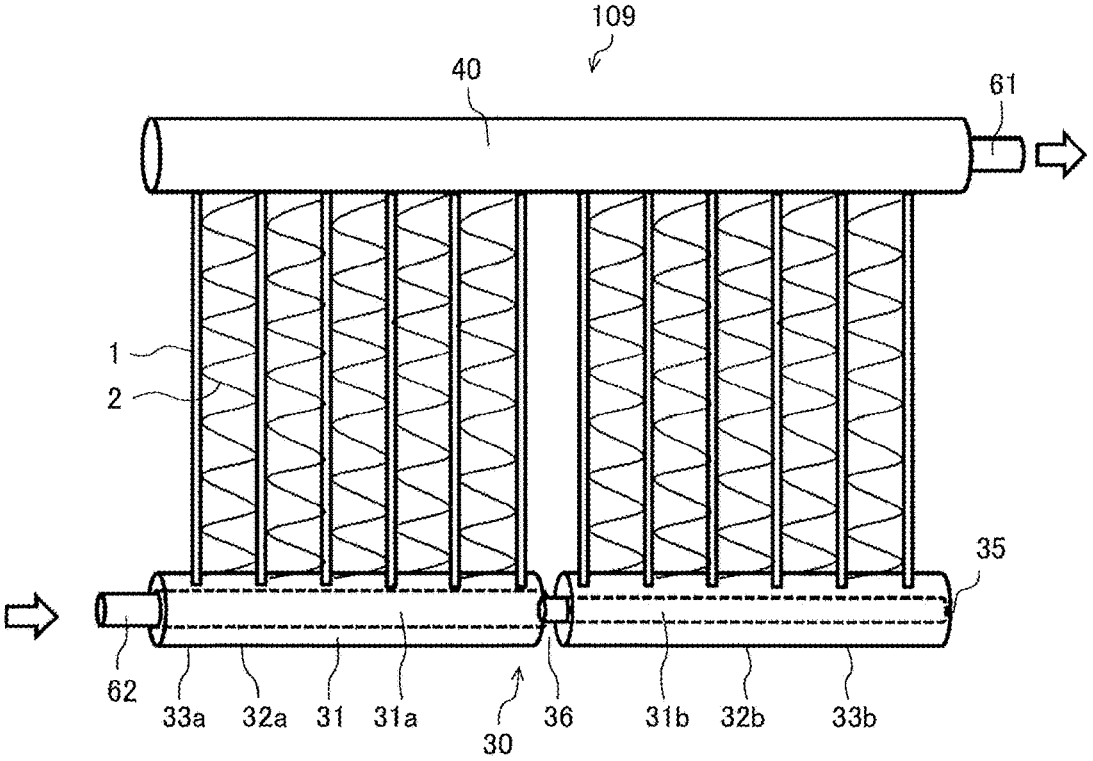
FIG. 7 is a schematic side view illustrating a heat exchanger according to Embodiment 2 of the present disclosure.

FIG. 7 is a schematic side view illustrating an outdoor heat exchanger 107 according to Embodiment 2 of the present disclosure. Hereinafter, the same configuration as that in the above embodiment is not described, and only its features are described. As illustrated in FIG. 7, the plurality of outer pipes 32*a* and 32*b* of the refrigerant distributor 30 are separated and connected to the respective outdoor heat exchangers 107, and only the inner pipe 31 is continuous through and connected to the plurality of outer pipes 32*a* and 32*b*. Upper parts of the plurality of outdoor heat exchangers 107 are connected to a refrigerant pipe 61 via the header collecting pipe 40.

The inner pipe 31 in each of the double-pipe portions 33*a* and the inner pipe 31 in each of the double-pipe portions 33*b* are separated and have different pipe diameters. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31. Specifically, in the direction of white arrows in FIG. 7, in which two-phase gas-liquid refrigerant flows through the inner pipe 31 from the refrigerant pipe 62 when the outdoor heat exchanger 107 functions as an evaporator, the pipe diameter of an inner pipe 31*a* in the double-pipe portion 33*a* on the upstream side is larger than the pipe diameter of an inner pipe 31*b* in the double-pipe portion 33*b* on the downstream side. In other words, the pipe diameter of the inner pipe 31*b* in the double-pipe portion 33*b* on the downstream side is smaller than the pipe diameter of the inner pipe 31*a* in the double-pipe portion 33*a* on the upstream side.

With this structure, refrigerant flow varies from annular flow to separated flow on the downstream side in the inner pipe 31*b*, where the refrigerant flow rate is lower than that in the vicinity of the inlet of the inner pipe 31*a*. Thus, it is possible to reduce impairment of the performance of distributing the refrigerant passing through the refrigerant outlets 34. The position where the pipe diameter of the inner pipe 31 is changed is determined on the basis of a common flow pattern map of refrigerant, such as a modified Baker chart, and the pipe diameter of the inner pipe 31 is changed such that most of the refrigerant flow in the inner pipe 31 does not become separated flow.

<Relationships Between Flow States and Distribution Characteristics of Refrigerant in Inner Pipe 31>

Figure 8:
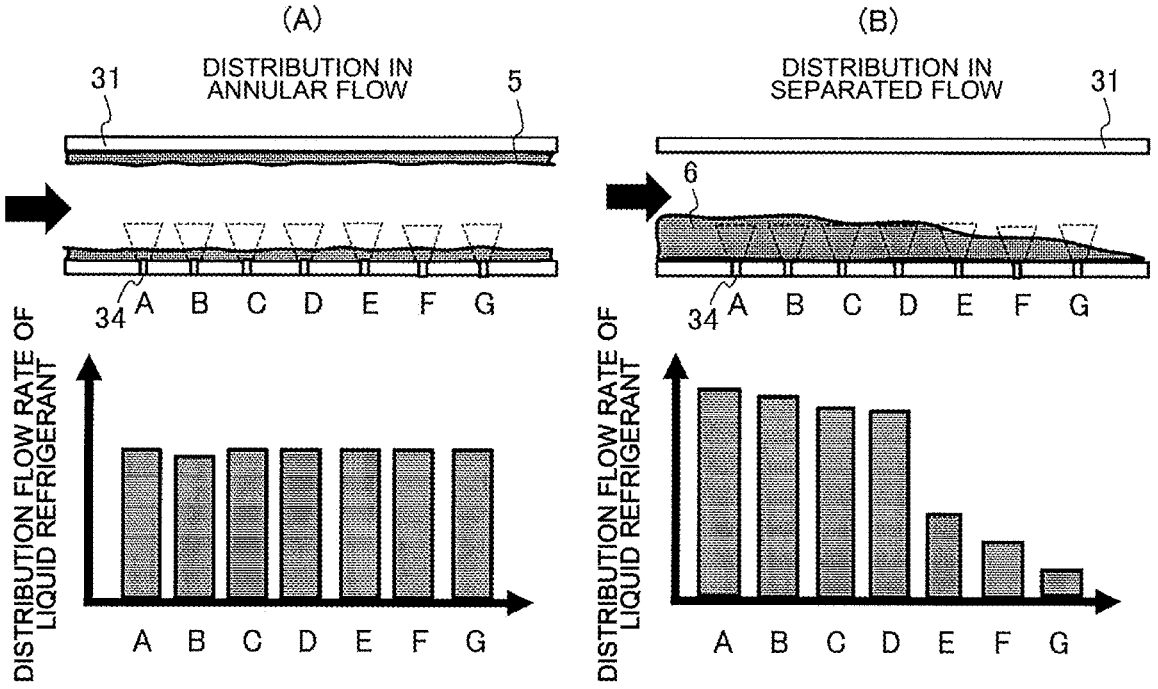
FIG. 8 illustrates the relationships between flow states and distribution characteristics of refrigerant in an inner pipe according to Embodiment 2 of the present disclosure.

FIG. 8 illustrates the relationships between flow states and distribution characteristics of refrigerant in the inner pipe 31 according to Embodiment 2 of the present disclosure. FIG. 8 illustrates the ratio between flow rates of the liquid refrigerant passing through the refrigerant outlets 34 when the refrigerant flow in the inner pipe 31 is annular flow in FIG. 8(A) and when the refrigerant flow in the inner pipe 31 is separated flow in FIG. 8(B). The relationships in FIG. 8 result from tests and calculations performed by the inventors. In the refrigerant outlets 34 in FIG. 8, the position closer to the refrigerant inlet is defined as A, and the position farther from the refrigerant inlet is defined as G in alphabetical order. Dashed lines in FIG. 8 represent the ranges in which the refrigerant outlets 34 affect refrigerant flow, and the refrigerant inside the dashed lines passes through the refrigerant outlets 34 and is distributed in a certain time. When the flow pattern of refrigerant is annular flow in FIG. 8(A), a thin liquid film 5 is formed to cover the entire inner surface of the inner pipe 31, and the thin liquid film 5 has almost the same thickness at any position in the direction in which the inner pipe 31 extends. Thus, the same amount of liquid refrigerant is distributed through almost all of the refrigerant outlets 34.

On the other hand, when the flow pattern of refrigerant is separated flow in FIG. 8(B), a refrigerant liquid film 6 is thicker than the thin liquid film 5 in annular flow. In addition, a large amount of liquid refrigerant is distributed in a lower portion in the inner pipe 31 due to gravity. Thus, the amounts of liquid refrigerant distributed through the refrigerant outlets 34 are larger toward the refrigerant inlet. As a result, the refrigerant distribution performance is impaired, and impairment of heat exchange efficiency is caused.

<Modification 3>

Figure 9:
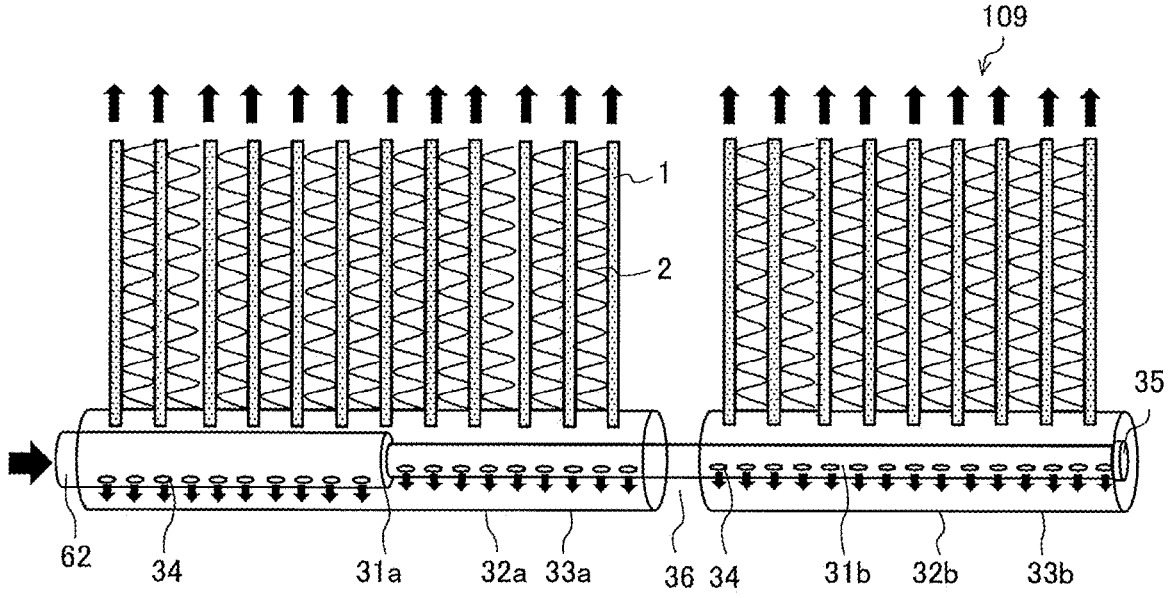
FIG. 9 is a schematic side view illustrating another example of the heat exchanger according to Embodiment 2 of the present disclosure.

FIG. 9 is a schematic side view illustrating another example of the outdoor heat exchanger 107 according to Embodiment 2 of the present disclosure. Hereinafter, the same configuration as that in the above embodiment is not described, and only its features are described. As illustrated in FIG. 9, the inner pipe 31 is separated in the direction in which the inner pipe 31 extends, and each separate inner pipe 31 has a different pipe diameter. Specifically, in the directions of black arrows in FIG. 9, in which two-phase gas-liquid refrigerant flows through the inner pipe 31 when the outdoor heat exchanger 107 functions as an evaporator, the inner pipe 31*a* in the double-pipe portion 33*a* on the upstream side is separated in the direction in which the inner pipe 31*a* extends, and the pipe diameter of one separate inner pipe 31*a* on the upstream side is set to be larger than that of the other separate inner pipe 31*a* on the downstream side.

As described above, the pipe diameter of the inner pipe 31*a* changes in the double-pipe portion 33*a* on the upstream side. This structure enables the pipe diameter of the inner pipe 31 to be finely changed on the basis of flow patterns and thus the refrigerant distribution performance to be improved.

<Modification 4>

Figure 10:
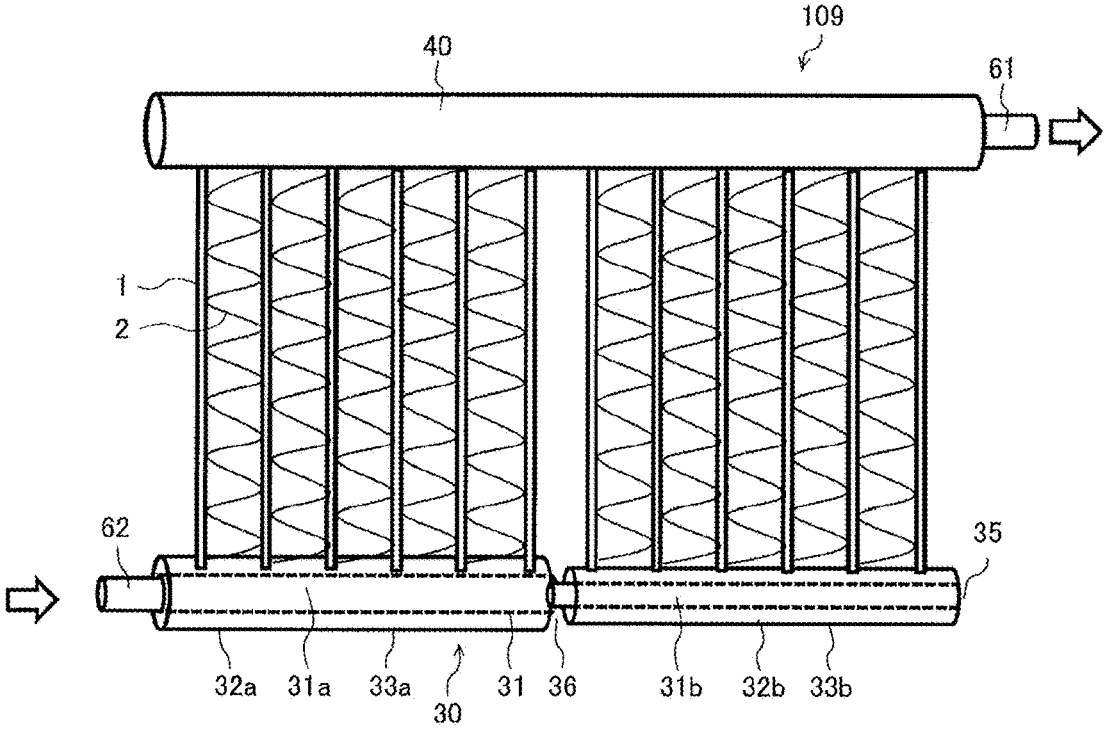
FIG. 10 is a schematic side view illustrating still another example of the heat exchanger according to Embodiment 2 of the present disclosure.

FIG. 10 is a schematic side view illustrating still another example of the outdoor heat exchanger 107 according to Embodiment 2 of the present disclosure. Hereinafter, the same configuration as that in the above embodiment is not described, and only its features are described. As illustrated in FIG. 10, the outer pipes 32*a* and 32*b* are separated in the direction in which the inner pipe 31 extends and have different pipe diameters. Specifically, in the direction of arrows in FIG. 10, in which two-phase gas-liquid refrigerant flows through the inner pipe 31 when the outdoor heat exchanger 107 functions as an evaporator, the pipe diameter of the outer pipe 32*a* in the double-pipe portion 33*a* on the upstream side is larger than the pipe diameter of the outer pipe 32*b* in the double-pipe portion 33*b* on the downstream side. More specifically, the pipe diameter of the inner pipe 31*b* in the double-pipe portion 33*b* on the downstream side is smaller than the pipe diameter of the inner pipe 31*a* in the double-pipe portion 33*a* on the upstream side, and the pipe diameter of the outer pipe 32*b* in the double-pipe portion 33*b* on the downstream side is smaller than the pipe diameter of the outer pipe 32*a* in the double-pipe portion 33*a* on the upstream side.

With this structure, in addition to improved refrigerant distribution performance, it is possible to further reduce the amount of refrigerant flowing through the refrigerant distributor 30. In addition, when the outdoor heat exchanger 107 functions as a condenser, it is possible to reduce impairment of heat exchange efficiency because refrigerant liquid hardly remains inside the refrigerant distributor 30.

<Modification 5>

Figure 11:
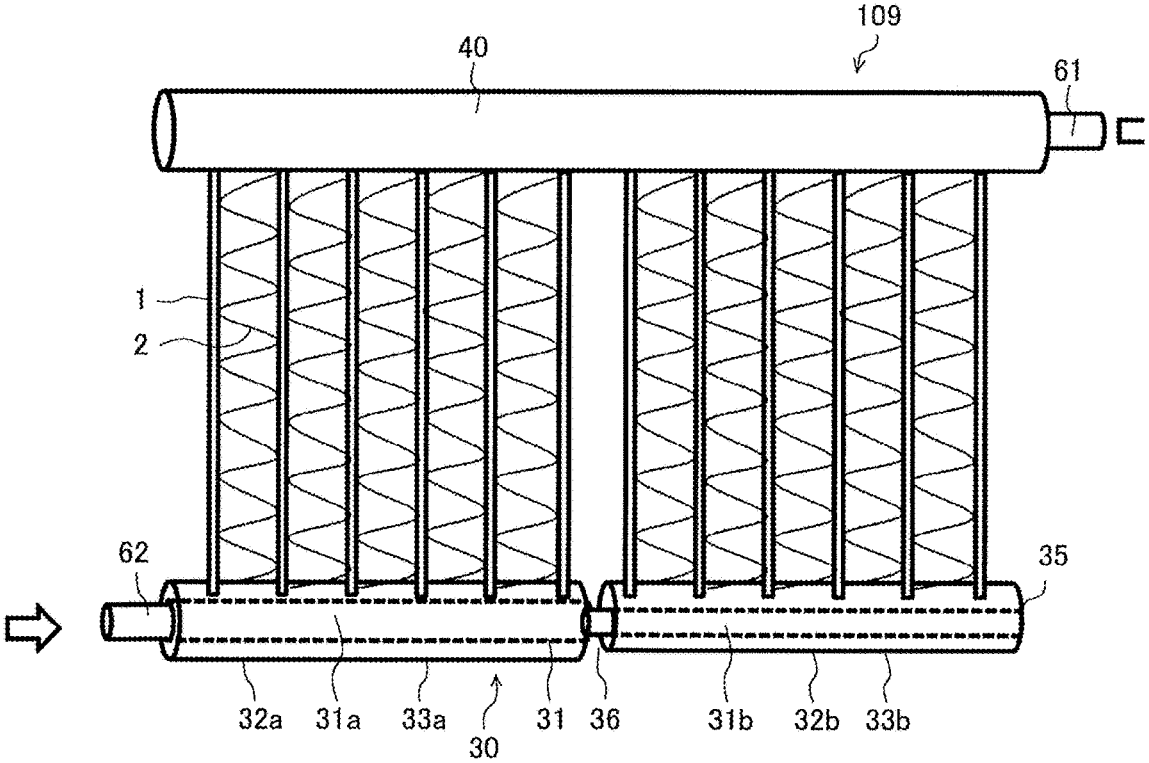
FIG. 11 is a schematic side view illustrating still another example of the heat exchanger according to Embodiment 2 of the present disclosure.

FIG. 11 is a schematic side view illustrating still another example of the outdoor heat exchanger 107 according to Embodiment 2 of the present disclosure. Hereinafter, the same configuration as that in the above embodiment is not described, and only its features are described. As illustrated in FIG. 11, the center of the outer pipe 32*b* in the double-pipe portion 33*b* on the downstream side is eccentrically upward relative to the center of the inner pipe 31*b* in the double-pipe portion 33*b* on the downstream side. The top of the outer pipe 32*a* in the double-pipe portion 33*a* on the upstream side and the top of the outer pipe 32*b* in the double-pipe portion 33*b* on the downstream side are aligned. The length of each of the parts of the heat-transfer tubes 1, which are flat tubes, inserted in the outer pipe 32*a* is equal to the length of each of the parts of the heat-transfer tubes 1, which are flat tubes, inserted in the outer pipe 32*b*.

With this structure, the brazing margins of the heat-transfer tubes 1, which are flat tubes, in the plurality of double-pipe portions 33*a* and 33*b* can be substantially uniform, and thus the ease of brazing is further improved. In addition, it is sufficient to dispose the heat-transfer tubes 1, which are flat tubes, having the same length side by side in the plurality of outdoor heat exchangers 107, and multiple kinds of heat-transfer tubes 1, which are flat tubes, do not have to be prepared. Thus, manufacturability is further improved. In addition, when the outdoor heat exchanger 107 functions as a condenser, it is possible to reduce impairment of heat exchange efficiency because refrigerant liquid hardly remains inside the refrigerant distributor 30.

Effects of Embodiment 2

According to Embodiment 2, the inner pipe 31 in each of the double-pipe portions 33*a* and the inner pipe 31 in each of the double-pipe portions 33*b* are separated and have different pipe diameters. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31.

This configuration enables the pipe diameter of the inner pipe 31 to be changed on the basis of the flow pattern of refrigerant flowing through the inner pipe 31 and thus the refrigerant distribution performance to be improved.

According to Embodiment 2, the inner pipe 31 is separated in the direction in which the inner pipe 31 extends, and each separate inner pipe 31 has a different pipe diameter.

This configuration enables the pipe diameter of the inner pipe 31 to be finely changed on the basis of the flow pattern of refrigerant flowing through the inner pipe 31 and thus the refrigerant distribution performance to be further improved.

According to Embodiment 2, the outer pipes 32*a* and 32*b* are separated in the direction in which the inner pipe 31 extends and have different pipe diameters.

With this configuration, in addition to improved refrigerant distribution performance, it is possible to further reduce the amount of refrigerant flowing through the refrigerant distributor 30. In addition, when the outdoor heat exchanger 107 functions as a condenser, it is possible to reduce impairment of heat exchange efficiency because refrigerant liquid hardly remains inside the refrigerant distributor 30.

Embodiment 3

<Outdoor Heat Exchanger 107>

Figure 12:
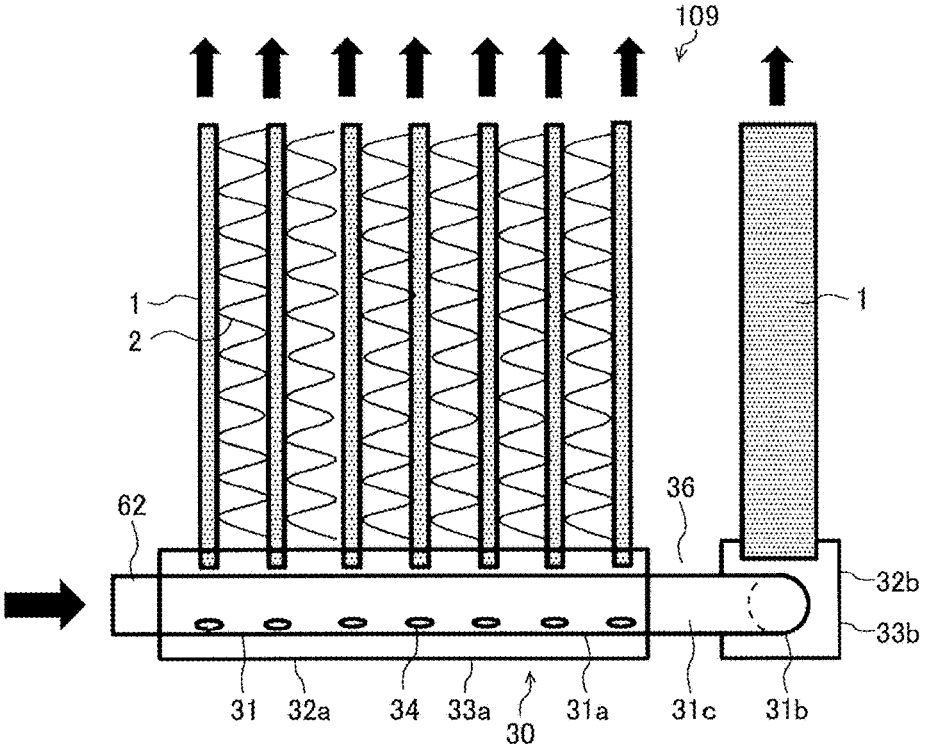
FIG. 12 is a schematic side view illustrating an example of a heat exchanger according to Embodiment 3 of the present disclosure.

FIG. 12 is a schematic side view illustrating an example of an outdoor heat exchanger 107 according to Embodiment 3 of the present disclosure. Hereinafter, the same configurations as those in the above embodiments are not described, and only its features are described. As illustrated in FIG. 12, the outer pipes 32*a* and 32*b* of the refrigerant distributor 30 are separated and connected to the respective outdoor heat exchangers 107.

The inner pipe 31 has a bent portion 31*c* between the double-pipe portions 33*a* and 33*b* adjacent to each other of the plurality of double-pipe portions 33*a* and 33*b*. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31. Specifically, the inner pipe 31 connects the double-pipe portions 33*a* and 33*b* adjacent to each other to form an L shape.

The inner pipe 31 is formed into the bent portion 31*c* having an L shape, and only the inner pipe 31 connects the outdoor heat exchangers 107 adjacent to each other. Thus, for example, when the outdoor heat exchangers 107 are disposed, to form an L shape in top view, via the bent inner pipe 31 having an L shape, the bend radius of a bent pipe can be reduced. As a result, it is possible to increase the mounting areas of the outdoor heat exchangers 107 and to improve heat exchange efficiency.

<Top View of Outdoor Heat Exchangers 107>

Figure 13:
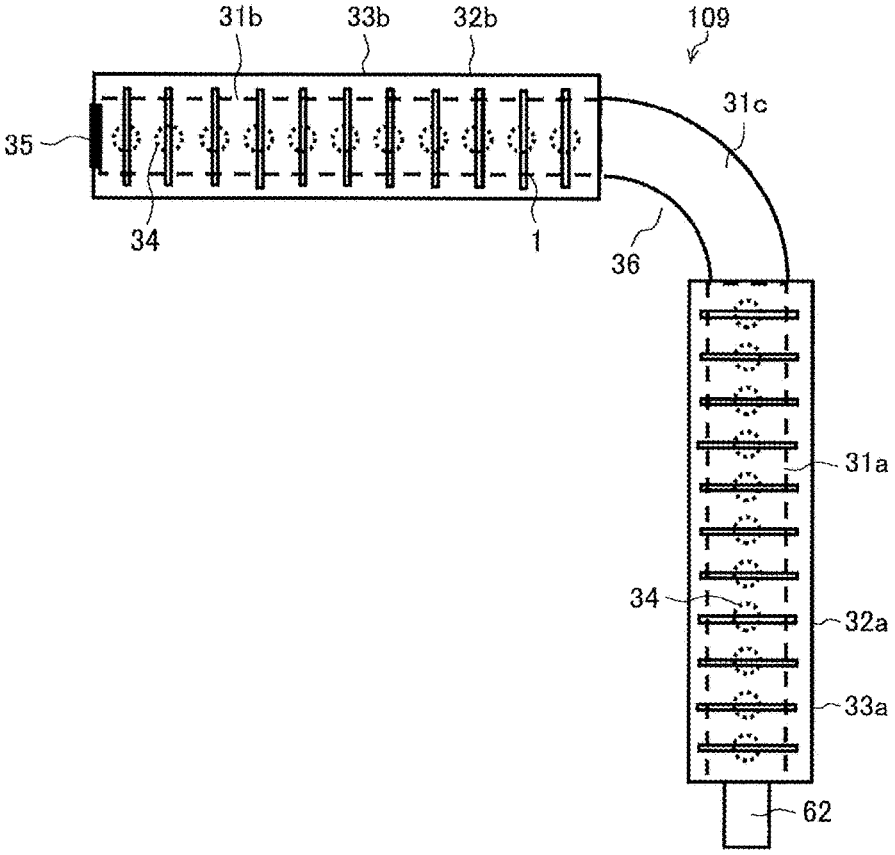
FIG. 13 is a schematic top view illustrating the example of the heat exchanger according to Embodiment 3 of the present disclosure.

FIG. 13 is a schematic top view illustrating the example of the outdoor heat exchanger 107 according to Embodiment 3 of the present disclosure. FIG. 13 illustrates, as an example, the refrigerant distributor 30 in the case of the outdoor heat exchangers 107 disposed to form an L shape in top view. However, the configuration is not limited to only a configuration in which the outdoor heat exchangers 107 are disposed to form an L shape in top view.

<Modification 6>

Figure 14:
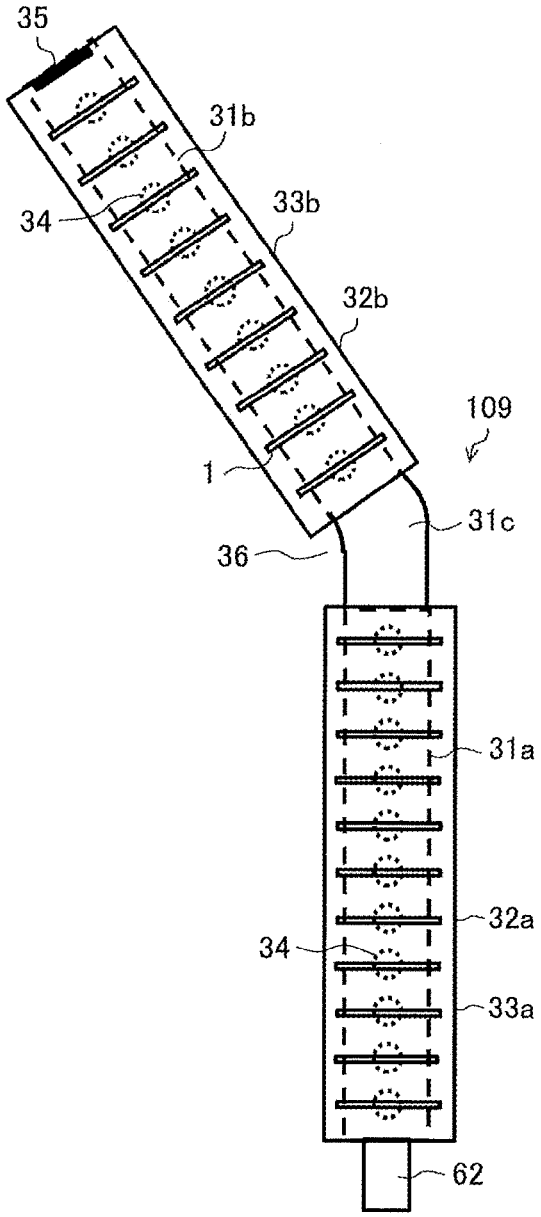
FIG. 14 is a schematic top view illustrating another example of the heat exchanger according to Embodiment 3 of the present disclosure.

FIG. 14 is a schematic top view illustrating another example of the outdoor heat exchanger 107 according to Embodiment 3 of the present disclosure. Hereinafter, the same configurations as those in the above embodiments are not described, and only its features are described. As illustrated in FIG. 14, a similar effect can be achieved also in the case of the inner pipe 31 disposed to be bent to have an obtuse angle. In addition, when the pipe diameter of the inner pipe 31*b* in the double-pipe portion 33*b* on the downstream side is reduced, the position of the inner pipe 31*b*, whose pipe diameter is reduced, is not limited to the downstream side of the bent portion 31*c*, which is a bent connecting pipe. However, refrigerant flow easily becomes turbulent at a position immediately downstream of the bent portion 31*c* having, for example, an L shape of the inner pipe 31. Thus, it is preferable to reduce the pipe diameter of the inner pipe 31 at this position because refrigerant flow velocity is increased and refrigerant flow easily transitions to annular flow. In addition, when the outdoor heat exchanger 107 functions as a condenser, it is possible to reduce impairment of heat exchange efficiency because refrigerant liquid hardly remains inside the refrigerant distributor 30.

Effects of Embodiment 3

According to Embodiment 3, the inner pipe 31 has the bent portion 31*c* between the double-pipe portions 33*a* and 33*b* adjacent to each other of the plurality of double-pipe portions 33*a* and 33*b*. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31.

With this configuration, only the inner pipe 31 having the bent portion 31*c* is continuous through the outer pipes 32*a* and 32*b*, and thus the bend radius of the bent pipe can be reduced. As a result, it is possible to increase the mounting areas of the outdoor heat exchangers 107 and to improve heat exchange efficiency.

Embodiment 4

<Outdoor Heat Exchanger 107>

Figure 15:
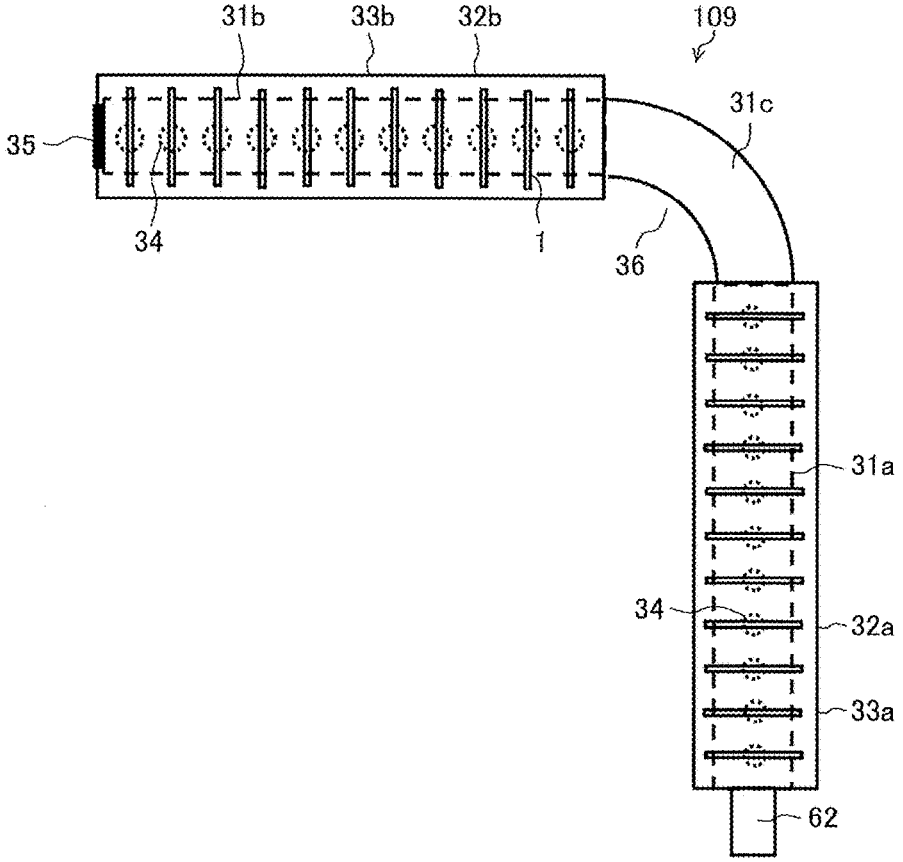
FIG. 15 is a schematic top view illustrating an example of a heat exchanger according to Embodiment 4 of the present disclosure.

FIG. 15 is a schematic top view illustrating an example of an outdoor heat exchanger 107 according to Embodiment 4 of the present disclosure. Hereinafter, the same configurations as those in the above embodiments are not described, and only its features are described. As illustrated in FIG. 15, a set of the plurality of refrigerant outlets 34 in each of the double-pipe portions 33*a* and a set of the plurality of refrigerant outlets 34 in each of the double-pipe portions 33*b* are separated and have different outlet diameters. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31. Specifically, in the direction in which two-phase gas-liquid refrigerant flows through the inner pipe 31 when the outdoor heat exchanger 107 functions as an evaporator, the outlet diameter of the refrigerant outlets 34 in the double-pipe portion 33*a* on the upstream side is set to be smaller than the outlet diameter of the refrigerant outlets 34 in the double-pipe portion 33*b* on the downstream side. More specifically, in the plurality of outdoor heat exchangers 107 connected only by the bent portion 31*c* having an L shape of the inner pipe 31, the outlet diameter of the refrigerant outlets 34 in the double-pipe portion 33*a* on the upstream side is smaller than the outlet diameter of the refrigerant outlets 34 in the double-pipe portion 33*b* on the downstream side.

With this structure, distribution of a large amount of refrigerant to the double-pipe portion 33*a* on the upstream side can be inhibited by flow resistance generated in a contact portion of the bent portion 31*c* having, for example, an L shape. As a result, the refrigerant distribution performance can be improved.

In FIG. 15, although the inner pipe 31 in the double-pipe portion 33*a* on the upstream side and the inner pipe 31 in the double-pipe portion 33*b* on the downstream side have the same pipe diameter, the configuration is not limited thereto. For example, it is more preferable that the pipe diameter of the inner pipe 31*b* in the double-pipe portion 33*b* on the downstream side be smaller than the pipe diameter of the inner pipe 31*a* in the double-pipe portion 33*a* on the upstream side. In this case, the influence of flow resistance generated due to pipe contraction at the part where the pipe diameter of the inner pipe 31 is changed can be reduced by the pipe diameter difference in the inner pipe 31.

Effects of Embodiment 4

According to Embodiment 4, a set of the refrigerant outlets 34, which are a plurality of openings, in each of the double-pipe portions 33*a* and a set of the refrigerant outlets 34, which are a plurality of openings, in each of the double-pipe portions 33*b* are separated and have different outlet diameters. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31.

With this configuration, distribution of an excessive amount of refrigerant to the upstream side in the refrigerant distributor 30 can be inhibited by flow resistance generated by refrigerant coming into contact with, for example, the bent portion 31*c* of the inner pipe 31 between the double-pipe portions 33*a* and 33*b* adjacent to each other. As a result, the refrigerant distribution performance can be improved.

Embodiment 5

<Outdoor Heat Exchanger 107>

Figure 16:
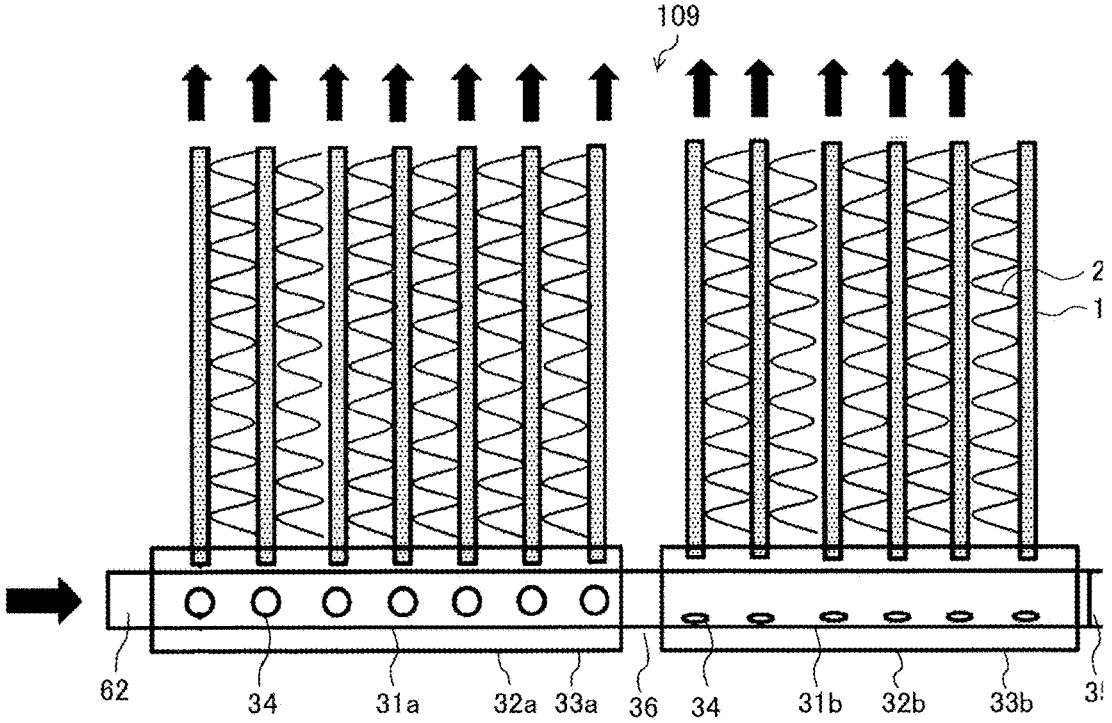
FIG. 16 is a schematic side view illustrating an example of a heat exchanger according to Embodiment 5 of the present disclosure.

FIG. 16 is a schematic side view illustrating an example of an outdoor heat exchanger 107 according to Embodiment 5 of the present disclosure. Hereinafter, the same configurations as those in the above embodiments are not described, and only its features are described. As illustrated in FIG. 16, a set of the plurality of refrigerant outlets 34 in each of the double-pipe portions 33*a* and a set of the plurality of refrigerant outlets 34 in each of the double-pipe portions 33*b* are separated and formed at different positions. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31. Specifically, in the plurality of outdoor heat exchangers 107 connected only by the bent portion 31*c*, the positions of the refrigerant outlets 34 disposed in the inner pipe 31*a* in the double-pipe portion 33*a* on the upstream side are higher than the positions of the refrigerant outlets 34 disposed in the double-pipe portion 33*b* on the downstream side.

According to tests and analyses performed by the inventors, this structure enables liquid refrigerant to flow sufficiently to the downstream side in the refrigerant distributor 30 at a low refrigerant flow velocity.

Effects of Embodiment 5

According to Embodiment 5, a set of the refrigerant outlets 34, which are a plurality of openings, in each of the double-pipe portions 33*a* and a set of the refrigerant outlets 34, which are a plurality of openings, in each of the double-pipe portions 33*b* are separated and formed at different positions. The double-pipe portion 33*a* has a double-pipe structure composed of the outer pipe 32*a* and the inner pipe 31. The double-pipe portion 33*b* has a double-pipe structure composed of the outer pipe 32*b* and the inner pipe 31.

This configuration enables liquid refrigerant to flow sufficiently to the downstream side in the refrigerant distributor 30 at a low refrigerant flow velocity.

Embodiment 6

<Outdoor Heat Exchanger 107>

Figure 17:
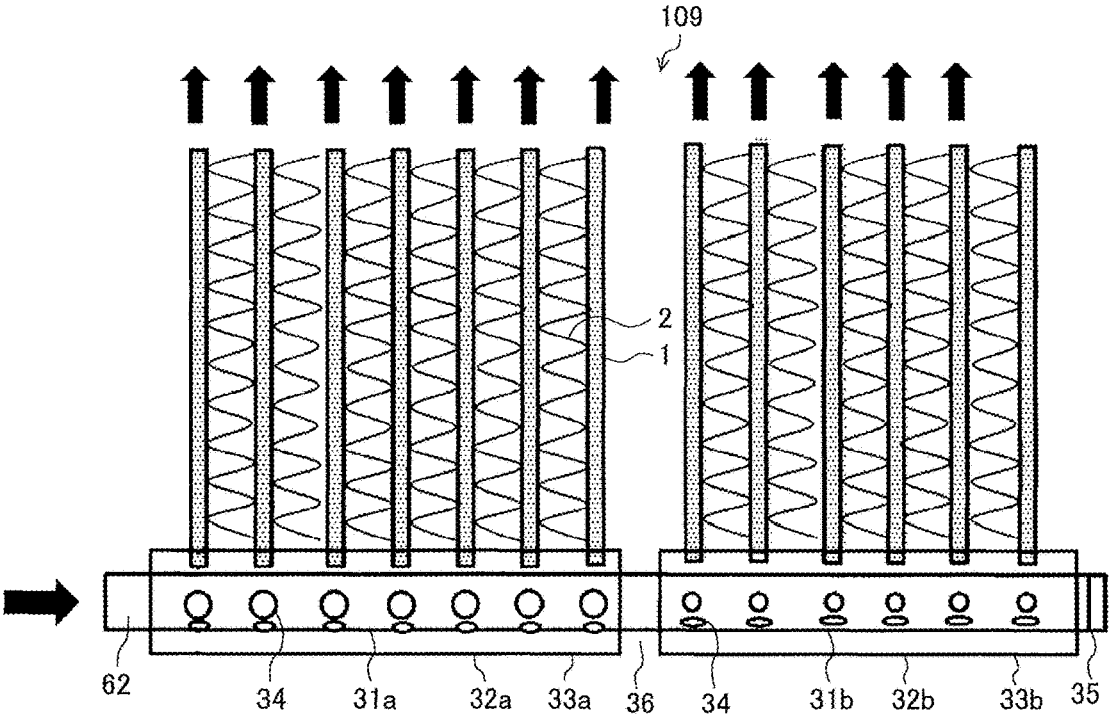
FIG. 17 is a schematic side view illustrating an example of a heat exchanger according to Embodiment 6 of the present disclosure.

FIG. 17 is a schematic side view illustrating an example of an outdoor heat exchanger 107 according to Embodiment 6 of the present disclosure. Hereinafter, the same configurations as those in the above embodiments are not described, and only its features are described. As illustrated in FIG. 17, the plurality of refrigerant outlets 34 are separated in the direction in which the inner pipe 31 extends, and each separate set of the refrigerant outlets 34 has a different outlet diameter. The plurality of refrigerant outlets 34 are separated in the direction in which the inner pipe 31 extends, and each separate set of the refrigerant outlets 34 has a different up-down position. The region in which the plurality of refrigerant outlets 34 are formed is separated in the direction in which the inner pipe 31 extends. The region in which the plurality of refrigerant outlets 34 are formed includes the region in which the small refrigerant outlets 34 at lower positions and the large refrigerant outlets 34 at higher positions are formed. In addition, the region in which the plurality of refrigerant outlets 34 are formed includes the region in which the large refrigerant outlets 34 at lower positions and the small refrigerant outlets 34 at higher positions are formed.

Specifically, the plurality of outdoor heat exchangers 107 are connected only by the inner pipe 31. At least two kinds of the refrigerant outlets 34, whose up-down positions are different from each other and outlet diameters are different from each other, are formed at the inner pipe 31 in each of the double-pipe portions 33*a* on the upstream side and the inner pipe 31 in each of the double-pipe portions 33*b* on the downstream side. More specifically, the outlet diameter of the refrigerant outlets 34 at lower positions in the double-pipe portion 33*a* on the upstream side is smaller than the outlet diameter of the refrigerant outlets 34 at lower positions in the double-pipe portion 33*b* on the downstream side. On the other hand, the outlet diameter of the refrigerant outlets 34 at higher positions in the double-pipe portion 33*a* on the upstream side is larger than the outlet diameter of the refrigerant outlets 34 at higher positions in the double-pipe portion 33*b* on the downstream side.

With this structure, refrigerant flows like separated flow at a low refrigerant flow velocity. Thus, since the outlet diameter of the refrigerant outlets 34 at lower positions in the double-pipe portion 33*a* on the upstream side is small, it is possible to inhibit a large amount of liquid refrigerant from being distributed to the refrigerant outlets 34 at lower positions in the double-pipe portion 33*a* on the upstream side. As a result, liquid refrigerant can flow sufficiently into the double-pipe portion 33*b* on the downstream side. In addition, refrigerant flows like annular flow at a high refrigerant flow velocity. Thus, liquid refrigerant can be distributed through the refrigerant outlets 34 at higher positions and lower positions in the double-pipe portion 33*a* on the upstream side and the refrigerant outlets 34 at higher positions and lower positions in the double-pipe portion 33*b* on the downstream side. As a result, the refrigerant distribution performance can be improved. That is, the refrigerant distribution performance can be improved under a wide range of operational conditions.

Effects of Embodiment 6

According to Embodiment 6, the refrigerant outlets 34, which are a plurality of openings, are separated in the direction in which the inner pipe 31 extends, and each separate set of the refrigerant outlets 34 has a different outlet diameter.

With this configuration, the refrigerant distribution performance can be improved according to refrigerant flow velocities under a wide range of operational conditions.

According to Embodiment 6, the refrigerant outlets 34, which are a plurality of openings, are separated in the direction in which the inner pipe 31 extends, and each separate set of the refrigerant outlets 34 has a different up-down position.

With this configuration, the refrigerant distribution performance can be improved according to refrigerant flow velocities under a wide range of operational conditions.

According to Embodiment 6, the region in which the refrigerant outlets 34, which are a plurality of openings, are formed is separated in the direction in which the inner pipe 31 extends. The region in which the refrigerant outlets 34 are formed includes the region in which the small refrigerant outlets 34 at lower positions and the large refrigerant outlets 34 at higher positions are formed, and the region in which the large refrigerant outlets 34 at lower positions and the small refrigerant outlets 34 at higher positions are formed.

With this configuration, refrigerant flows like separated flow at a low refrigerant flow velocity. Thus, since the outlet diameter of the refrigerant outlets 34 at lower positions on the upstream side is small, it is possible to inhibit an excessive amount of liquid refrigerant from being distributed to the upstream side. As a result, liquid refrigerant can flow sufficiently to the downstream side. In addition, refrigerant flows like annular flow at a high refrigerant flow velocity. Thus, liquid refrigerant can be distributed through the refrigerant outlets 34 at higher positions and lower positions on the upstream side and the refrigerant outlets 34 at higher positions and lower positions on the downstream side. As a result, the refrigerant distribution performance can be improved. That is, the refrigerant distribution performance can be improved according to refrigerant flow velocities under a wide range of operational conditions.

Embodiment 7

<Outdoor Heat Exchanger 107>

Figure 18:
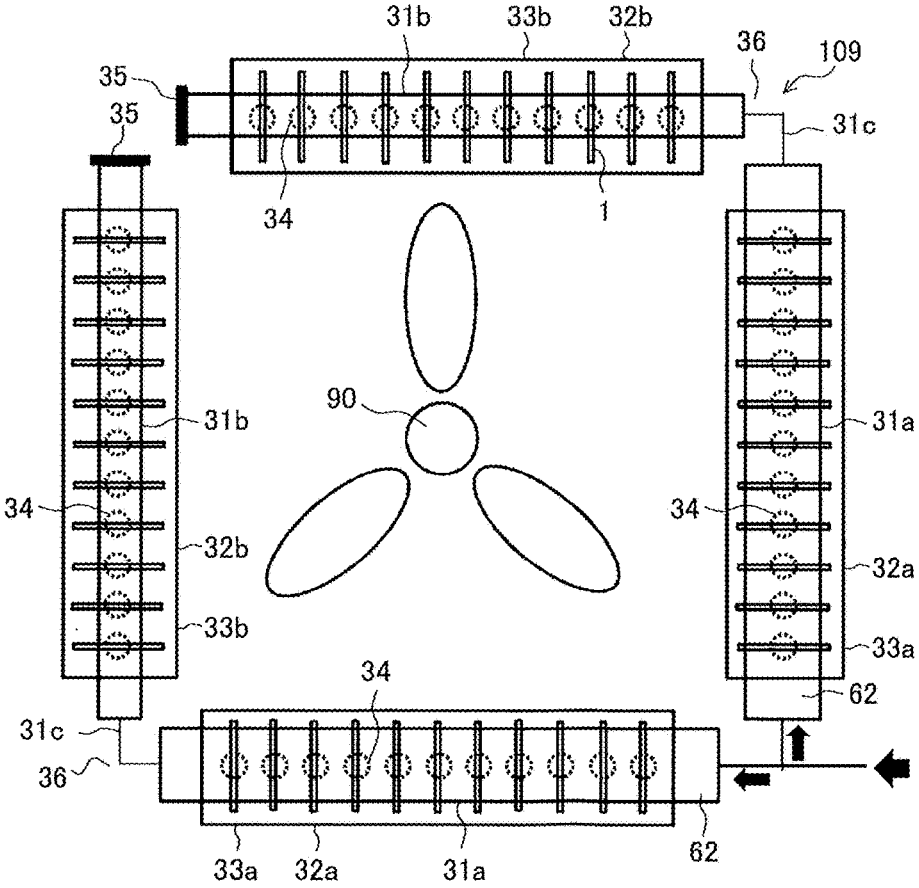
FIG. 18 is a schematic side view illustrating an example of a heat exchanger according to Embodiment 7 of the present disclosure.

FIG. 18 is a schematic side view illustrating an example of an outdoor heat exchanger 107 according to Embodiment 7 of the present disclosure. Hereinafter, the same configurations as those in the above embodiments are not described, and only its features are described. FIG. 18 illustrates two pairs of the outdoor heat exchangers 107 connected only by the respective bent portions 31*c* having an L shape of the inner pipe 31. Thus, the four outdoor heat exchangers 107 are disposed to surround the fan 90.

With this configuration, since the outdoor heat exchangers 107 are connected only by the bent portions 31*c* having an L shape of the inner pipe 31, the outdoor heat exchangers 107 can be disposed around the fan 90 with high density, and thus the heat transfer areas of the outdoor heat exchangers 107 can be increased. As a result, it is possible to improve energy efficiency. In addition, the pipe diameter of the inner pipe 31 in the outdoor heat exchangers 107 on the downstream side is reduced, and thus refrigerant flow velocity can be increased, the flow pattern of refrigerant becomes similar to annular flow, and the refrigerant distribution performance can be also improved.

<Modification 7>

Figure 19:
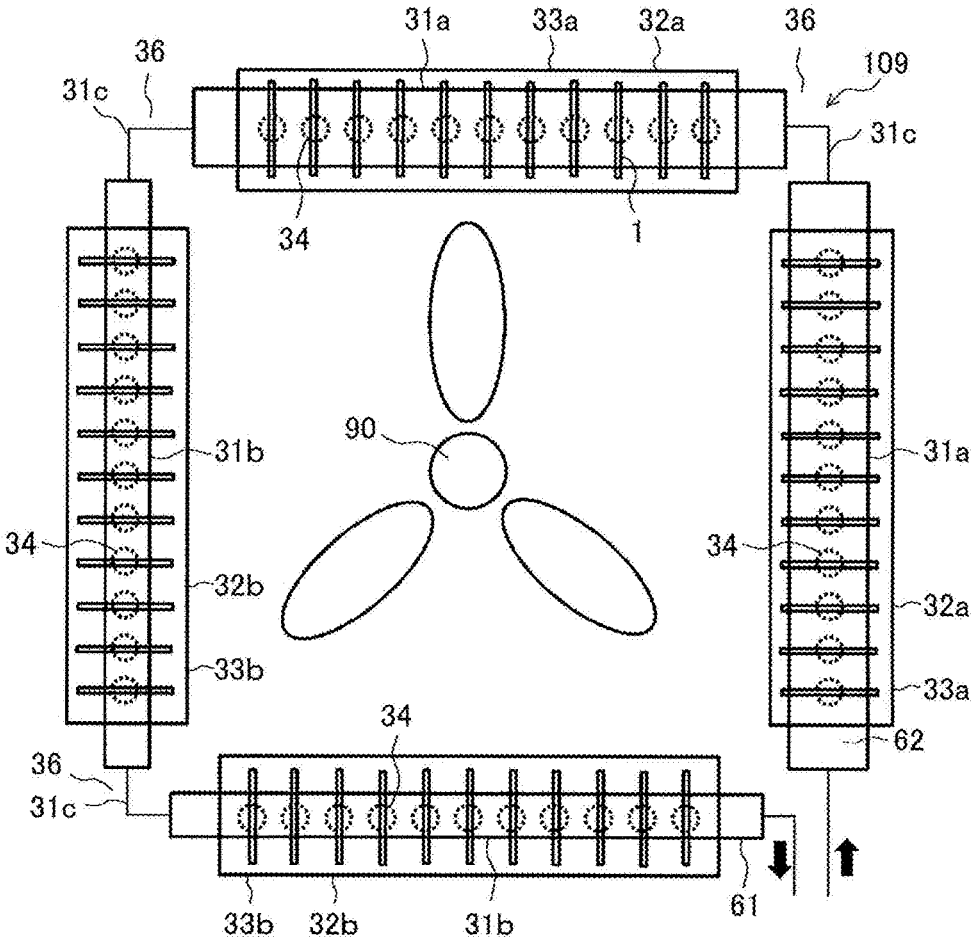
FIG. 19 is a schematic side view illustrating another example of the heat exchanger according to Embodiment 7 of the present disclosure.

FIG. 19 is a schematic side view illustrating another example of the outdoor heat exchanger 107 according to Embodiment 7 of the present disclosure. Hereinafter, the same configurations as those in the above embodiments are not described, and only its features are described. Although FIG. 18 illustrates two pairs of the outdoor heat exchangers 107 connected only by the respective bent portions 31*c* having an L shape of the inner pipe 31, the configuration is not limited thereto. As illustrated in FIG. 19, the four outdoor heat exchangers 107 may be connected in series only by the respective bent portions 31*c* having an L shape of the inner pipe 31.

In this case, the length of the refrigerant distributor 30 in the pipe-extending direction is large. Thus, the difference between the flow velocity of refrigerant flowing through the inner pipes 31*a* on the upstream side of the refrigerant distributor 30 and the flow velocity of refrigerant flowing through the inner pipes 31*b* on the downstream side of the refrigerant distributor 30 is large. As a result, refrigerant flow in the inner pipes 31*b* on the downstream side easily becomes separated flow. For this reason, the effect of improving the refrigerant distribution performance resulting from reductions in the pipe diameters of the inner pipes 31*b* on the downstream side is particularly large.

Embodiment 1 to Embodiment 7 of the present disclosure may be combined or may be applied to other parts.

REFERENCE SIGNS LIST

1 heat-transfer tube 2 fin 5 thin liquid film 6 refrigerant liquid film 30 refrigerant distributor 31, 31*a*, 31*b* inner pipe 31*c* bent portion 32*a*, 32*b* outer pipe 33*a*, 33*b* double-pipe portion 34 refrigerant outlet 35 cap 40 header collecting pipe 41 header collecting pipe 61 refrigerant pipe 62 refrigerant pipe 90 fan 100 air-conditioning apparatus 101 outdoor unit 101*a* casing 101*b* air inlet 101*c* air outlet 101*d* fan guard 102 indoor unit 103 gas refrigerant pipe 104 liquid refrigerant pipe 105 compressor 106 four-way valve 107 outdoor heat exchanger 108 expansion valve 109 indoor heat exchanger

The invention claimed is:

1. A refrigerant distributor comprising a double-pipe structure including an inner pipe and an outer pipe, wherein a plurality of outer pipes are disposed, each of the plurality of outer pipes being the outer pipe, a space is formed between adjacent ones of the plurality of outer pipes, the inner pipe is disposed to be continuous through the plurality of outer pipes, a plurality of heat-transfer tubes are arrayed in a direction in which the outer pipe extends and connected to the outer pipe, and the refrigerant distributor thereby distributes refrigerant flowing into between the inner pipe and the outer pipe to the plurality of heat-transfer tubes.

2. The refrigerant distributor of claim 1, wherein a plurality of openings are formed at the inner pipe, the plurality of openings being disposed side by side with spaces between the plurality of openings in a direction in which the inner pipe extends in a plurality of double-pipe portions, each of the plurality of double-pipe portions having the double-pipe structure composed of a corresponding one of the plurality of outer pipes and the inner pipe.

3. The refrigerant distributor of claim 2, wherein a set of the plurality of openings in one of the plurality of double-pipe portions and a set of the plurality of openings in an other of the plurality of double-pipe portions are separated and have different opening diameters, each of the plurality of double-pipe portions having the double-pipe structure composed of a corresponding one of the plurality of outer pipes and the inner pipe.

4. The refrigerant distributor of claim 2, wherein a set of the plurality of openings in one of the plurality of double-pipe portions and a set of the plurality of openings in an other of the plurality of double-pipe portions are separated and formed at different positions, each of the plurality of double-pipe portions having the double-pipe structure composed of a corresponding one of the plurality of outer pipes and the inner pipe.

5. The refrigerant distributor of claim 2, wherein the plurality of openings are separated in the direction in which the inner pipe extends, and each separate set of the plurality of openings has a different opening diameter.

6. The refrigerant distributor of claim 2, wherein the plurality of openings are separated in the direction in which the inner pipe extends, and each separate set of the plurality of openings has a different up-down position.

7. The refrigerant distributor of claim 2, wherein a region in which the plurality of openings are formed is separated in the direction in which the inner pipe extends, and the region in which the plurality of openings are formed includes a region in which small openings at lower positions and large openings at higher positions are formed, and a region in which large openings at lower positions and small openings at higher positions are formed.

8. The refrigerant distributor of claim 1, wherein the inner pipe in one of the plurality of double-pipe portions and the inner pipe in an other of the plurality of double-pipe portions are separated and have different pipe diameters, each of the plurality of double-pipe portions having the double-pipe structure composed of a corresponding one of the plurality of outer pipes and the inner pipe.

9. The refrigerant distributor of claim 1, wherein the inner pipe is separated in the direction in which the inner pipe extends, and each separate inner pipe has a different pipe diameter.

10. The refrigerant distributor of claim 1, wherein the plurality of outer pipes are separated in the direction in which the inner pipe extends and have different pipe diameters.

11. The refrigerant distributor of claim 1, wherein the inner pipe has a bent portion between adjacent ones of the plurality of double-pipe portions, each of the plurality of double-pipe portions having the double-pipe structure composed of a corresponding one of the plurality of outer pipes and the inner pipe.

12. A heat exchanger comprising the refrigerant distributor of claim 1.

13. An air-conditioning apparatus comprising the heat exchanger of claim 12, wherein the direction in which the inner pipe of the refrigerant distributor of the heat exchanger extends is kept horizontal, and refrigerant containing liquid refrigerant flows into the inner pipe from one end of the inner pipe.

* * * * *